US006470970B1

(12) United States Patent
Purkis et al.

(10) Patent No.: US 6,470,970 B1
(45) Date of Patent: Oct. 29, 2002

(54) MULTIPLIER DIGITAL-HYDRAULIC WELL CONTROL SYSTEM AND METHOD

(75) Inventors: Dan Purkis, Cruden Bay (GB); Brett Bouldin, Spring; Richard Rubbo, The Woodlands, both of TX (US)

(73) Assignee: Welldynamics Inc., Spring, TX (US)

( * ) Notice: Subject to any disclaimer, the term of this patent is extended or adjusted under 35 U.S.C. 154(b) by 0 days.

(21) Appl. No.: 09/503,276

(22) Filed: Feb. 14, 2000

Related U.S. Application Data

(63) Continuation-in-part of application No. 09/133,747, filed on Aug. 13, 1998, now Pat. No. 6,179,052.

(51) Int. Cl.[7] ..... E21B 34/10

(52) U.S. Cl. ..... 166/374; 166/319; 166/53; 166/72

(58) Field of Search ..... 166/72, 53, 50, 166/319, 363, 364, 375, 374

(56) References Cited

U.S. PATENT DOCUMENTS

| | | | | |
|---|---|---|---|---|
| 3,702,909 A | | 11/1972 | Kraakman | |
| 4,036,106 A | | 7/1977 | Athy, Jr. | |
| 4,296,910 A | | 10/1981 | Gratzmuller | |
| 4,407,183 A | | 10/1983 | Milberger et al. | |
| 4,442,902 A | | 4/1984 | Doremus et al. | |
| 4,549,578 A | * | 10/1985 | Hibbs et al. | 137/552.5 |
| 4,796,699 A | * | 1/1989 | Upchurch | 166/250.17 |

FOREIGN PATENT DOCUMENTS

| | | | |
|---|---|---|---|
| EP | 0344060 | | 11/1989 |
| FR | 2052052 | * | 9/1971 |
| GB | 2335216 A | | 9/1999 |
| WO | WO97/47852 | | 12/1997 |
| WO | WO99/47788 | | 9/1999 |
| WO | WO00/09855 | | 2/2000 |

OTHER PUBLICATIONS

International Search Report Application No. PCT/US01/02306.

International Search Report Application No. PCT/US00/12329.

* cited by examiner

*Primary Examiner*—David Bagnell
*Assistant Examiner*—Daniel Stephenson
(74) *Attorney, Agent, or Firm*—Paul I. Herman; William M. Imwalle; Marlin R. Smith

(57) ABSTRACT

A system for transmitting hydraulic control signals or hydraulic power to downhole well tools while significantly reducing the number of hydraulic lines required. Hydraulic control signals are furnished at relatively low pressures to actuate a selected well tool, and the hydraulic pressure is selectively increased over a threshold level to provide hydraulic power to the well tool. The hydraulic control actuation signals can be controlled by selectively pressurizing different hydraulic lines in a selected sequence and by selectively powering the fluid pressure within a selected hydraulic line. The combination of selective sequential actuation and selective fluid pressure provides multiple actuation combinations for selectively actuating downhole well tools. Additional combinations can be provided by changing the pressurization sequence, magnitude, absolute time, duration, and pressurization profile within a discrete time period.

37 Claims, 3 Drawing Sheets

MULTIPLIER DIGITAL-HYDRAULIC WELL CONTROL SYSTEM AND METHOD

This patent application is a continuation-in-part patent application of U.S. Ser. No. 09/133,747 filed Aug. 13, 1998 now U.S. Pat. No. 6,179,052, entitled "Digital-Hydraulic Well Control System".

BACKGROUND OF THE INVENTION

The present invention relates to a system for controlling the production of hydrocarbons and other fluids from downhole wells. More particularly, the invention relates to a system for providing hydraulic control signals and power through multiple hydraulic lines by controlling power distribution to selective hydraulic lines.

Various tools and tool systems have been developed to control, select or regulate the production of hydrocarbon fluids and other fluids produced downhole from subterranean wells. Downhole well tools such as sliding sleeves, sliding windows, interval control lines, safety valves, lubricator valves, and gas lift valves are representative examples of control tools positioned downhole in wells.

Sliding sleeves and similar devices can be placed in isolated sections of the wellbore to control fluid flow from such wellbore section. Multiple sliding sleeves and interval control valves (ICVs) can be placed in different isolated sections within production tubing to jointly control fluid flow within the particular production tubing section, and to commingle the various fluids within the common production tubing interior. This production method is known as "comingling" or "coproduction". Reverse circulation of fluids through the production of tubing, known as "injection splitting", is performed by pumping a production chemical or other fluid downwardly into the production tubing and through different production tubing sections.

Wellbore tool actuators generally comprise short term or long term devices. Short term devices include one shot tools and tool having limited operating cycles. Long term devices can use hydraulically operated mechanical mechanisms performing over multiple cycles. Actuation signals are provided through mechanical, direct pressure, pressure pulsing, electrical, electromagnetic, acoustic, and other mechanisms. The control mechanism may involve simple mechanics, fluid logic controls, timers, or electronics. Motive power to actuated the tools can be provided through springs, differential pressure, hydrostatic pressure, or locally generated power.

Long term devices provide virtually unlimited operating cycles and are designed for operation through the well producing life. These devices are particularly useful in subsea wells and deep horizontal wells. One type of long term safety valve device closes the tubing interior with spring powered force when the hydraulic line pressure is lost. Other electrical and hydraulic combination powered systems have been developed for downhole use, and sensors can verify proper operation of tool components.

Interval control valve (ICV) activation is typically accomplished with mechanical techniques such as a shifting tool deployed from the well surface on a workstring or coiled tubing. This technique is expensive and inefficient because the surface controlled rigs may be unavailable, advance logistical planning is required, and hydrocarbon production is lost during operation of the shifting tool. Alternatively, electrical and hydraulic umbilical lines have been used to remotely control one or more ICVs without reentry into the wellbore.

Control for one downhole tool can be hydraulically accomplished by connecting a single hydraulic line to a tool such as an ICV or a lubricator valve, and by discharging hydraulic fluid from the line end into the wellbore. This technique has several limitations as the hydraulic fluid exits the wellbore because of differential pressures between the hydraulic line and the wellbore. Time delays in the propagation of pressure through several kilometers of thin hydraulic line, compressibility of the hydraulic fluid, and line friction impedes efficient hydraulic fluid operation. Additionally, the setting depths are limited by the maximum pressure that a pressure relief valve can hold between the differential pressure between the control line pressure and the production tubing when the system is at rest. These limitations restrict single line hydraulics to relatively low differential pressure applications such as lubricator valves and ESP sliding sleeves. Further, discharge of hydraulic fluid into the wellbore comprises an environmental discharge and risks backflow and particulate contamination into the hydraulic system. To avoid such contamination and corrosion problems, a closed loop hydraulic system would be preferred over hydraulic fluid discharge valves, however closed loop systems require at least one additional hydraulic line in the narrow wellbore confines.

Various proposals have been made for multiple tool operation through a single hydraulic line. U.S. Pat. No. 4,660,647 to Richart (1987) disclosed a system for changing downhole flow paths by providing different plug assemblies suitable for insertion within a side pocket mandrel downhole in the wellbore. In U.S. Pat. No. 4,796,699 to Upchurch (1989), an electronic downhole controller received pulsed signals for operating multiple well tools. In U.S. Pat. No. 4,942,926 to Lessi (1990), solenoid valves directed hydraulic fluid pressure from a single line to control different operations, and a spring return device facilitated return of the components to the original position. A second hydraulic line provided dual operation of the same tool function by controlling hydraulic fluid flow in different directions. Similarly, U.S. Pat. No. 4,945,995 to Thulance et al. (1990) disclosed an electrically operated solenoid valve for selectively controlling operation of a hydraulic line for opening downhole wellbore valves.

Other downhole well tools use two hydraulic lines to control a single tool. In U.S. Pat. No. 3,906,726 to Jameson (1975), a manual control disable valve and a manual choke control valve controlled the flow of hydraulic fluid on either side of a piston head. In U.S. Pat. No. 4,197,879 to Young (1980), and in U.S. Pat. No. 4,368,871 to Young (1983), two hydraulic hoses controlled from a vessel were selectively pressurized to open and close a lubricator valve during well test operations. A separate control fluid was directed by each hydraulic hose so that one fluid pressure opened the valve and a different fluid pressure closed the valve. In U.S. Pat. No. 4,476,933 to Brooks (1984), a piston shoulder functioned as a double acting piston in a lubricator valve, and two separate control lines were connected to conduits and to conventional fittings to provide high or low pressures in chambers on opposite sides of the piston shoulder. In U.S. Pat. No. 4,522,370 to Noack et al. (1985), a combined lubricator and retainer valve was operable with first and second pressure fluids and pressure responsive members, and two control lines provided two hydraulic fluid pressures to the control valve. Multiple hydraulic line techniques are typically inefficient because the volume of hydraulic lines required for multiple downhole tools cannot fit through packers and wellheads.

To avoid multiple hydraulic lines, other techniques have attempted to establish an operating sequence for well tools.

In U.S. Pat. No. 5,065,825 to Bardin et al. (1991), a solenoid valve was operated in response to a predetermined sequence to move fluid from one position to another. A check valve permitted discharge of oil into a reservoir to replenish the reservoir oil pressure. Other systems use electronic controllers downhole in the wellbore, however electronics are susceptible to temperature induced deterioration and other reliability problems.

Mechanical shifting devices have limitations in deep and horizontal wellbores. Frictional loads on the tool can encumber tool operation. The tool string weight in horizontal wells decentralizes the tool and reduces the ability of the tool to maintain an optimal position within the wellbore. A lack of surface feedback prevents confirmation of tool operation such as sleeve movement and latching. High friction loads can indicate tensile or compressive load indicators, leading to inaccurate assumptions regarding proper tool deployment.

Downhole hydraulic lines in a wellbore can extend for thousands of feet into the wellbore. In large wellbores having different production zones and multiple tool requirements, large numbers of hydraulic lines are required. Each line significantly increases installation costs and the number of components potentially subject to failure. The propagation time necessary to transfer hydraulic fluid pressure, and pressure gradients within each hydraulic fluid line, can limit effective well control responses. The effectiveness of hydraulic fluid lines is further limited by hydraulic lines that become pinched or otherwise damaged.

Accordingly, a need exists for an improved well control system capable of avoiding the limitations of prior art devices. The system should be reliable, should be adaptable to different tool configurations and combinations, and should be inexpensive to deploy.

SUMMARY OF THE INVENTION

The present invention provides a system for transmitting pressurized fluid between a wellbore surface and a well tool located downhole in the wellbore. The comprises at least two hydraulic lines engaged with the well tool for conveying the fluid to the well tool. Each hydraulic line is capable of providing communication control signals to actuate the well tool and of providing fluid pressure to operate the well tool, and a controller for selectively pressurizing the fluid within each hydraulic line to provide said communication signals to the well tool in a selected fluid pressure sequence or a selected fluid pressure or combination to actuate the well tool. The controller is further capable of increasing the pressure within one of said hydraulic lines to operate the well tool.

A return line can convey hydraulic fluid from the well tools to the wellbore surface, and an actuator can be engaged between each hydraulic line and each well tool to be actuatable in response to different variables to initiate well tool operation. Useful variables include sequential operation of control lines, selective application of power to control lines, through time operated sequences of pulses or pressure application, through combinations of coded sequences, through metering of an absolute amount of fluid flow to initiate tool activation, and others.

DESCRIPTION OF THE PREFERRED EMBODIMENTS

The invention provides unique operation for downhole well tools by providing multiple power and sequential logic circuit control combinations with minimal hydraulic lines. Such logic circuitry is analogous to electrical and electronics systems and incorporates Boolean Logic using "AND" and "OR" gates in the form of hydraulic switches. Using this unique concept, digital control capability, or "digital-hydraulics" can be adapted to the control of downhole well tools such as ICVs and other downhole tools.

Figure 1:
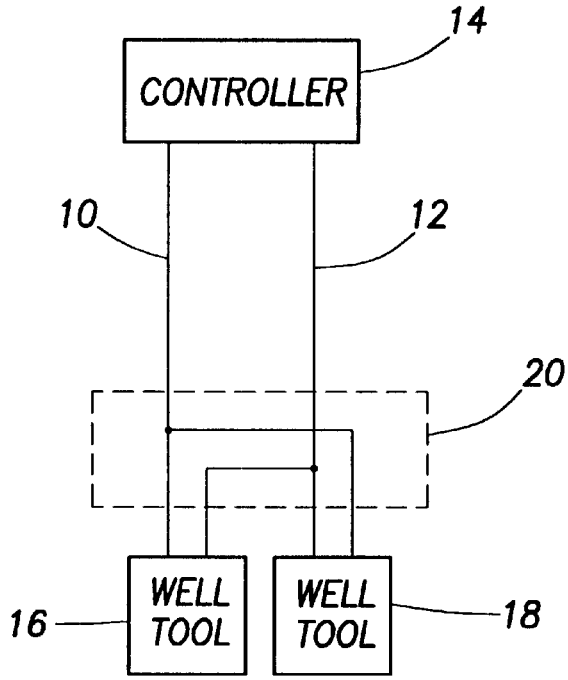
FIG. 1 illustrates a two hydraulic line system for providing hydraulic pressure control and power to well tools.

FIG. 1 illustrates two hydraulic lines 10 and 12 engaged with pump such as controller 14 for providing hydraulic pressure to fluid (not shown) in lines 10 and 12. Lines 10 and 12 are further engaged with downhole well tools 16 and 18 for providing hydraulic fluid pressure to tools 16 and 18. Controller 14 can selectively control the fluid pressure within lines 10 and 12 and can cooperate with one or more hydraulic control means or hydraulic manifolds such as actuator 20 located downhole in the wellbore in engagement with lines 10 and 12 and with tools 16 and 18. Selective control over the distribution of hydraulic fluid pressure can be furnished and controlled with pump 14 at the wellbore surface, or with actuator 20 downhole in the wellbore. Control signals to tools 16 and 18 and actuator 20 can be provided within a different pressure range as that required for actuation of tools 16 and 18, and such pressure range or ranges can be higher, lower, or overlapping. Controller 14 can incorporate a fluid sensor to detect fluid returned through return line to the well surface, or a different fluid sensor can be incorporated.

Figure 2:
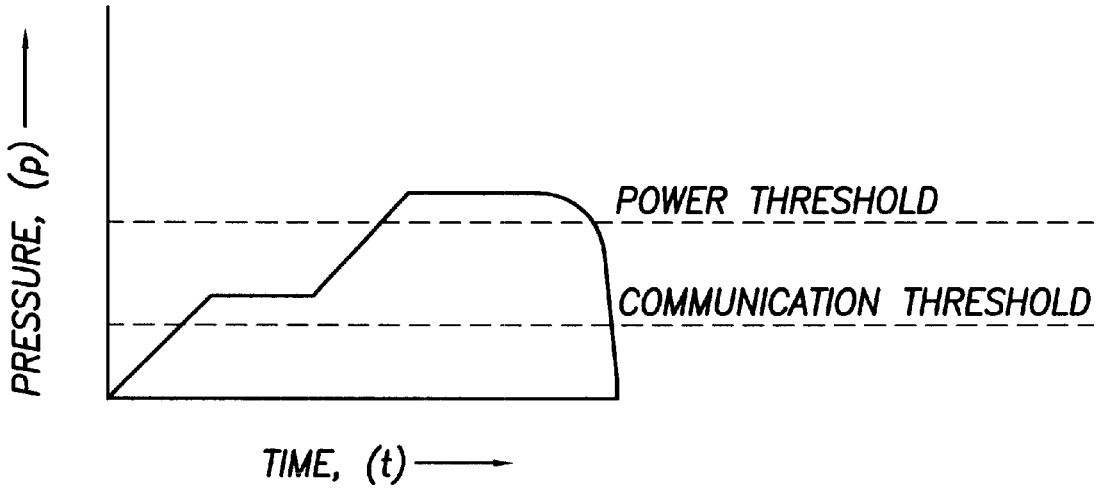
FIG. 2 illustrates a graph showing a hydraulic line pressure code for providing hydraulic control and power capabilities through the same hydraulic line.

FIG. 2 illustrates one combination of communication and power functions through the same hydraulic tubing, conduit, passage or line such as line 10 wherein the control signals are provided at lower pressures than the power actuation pressures. Pressure is plotted against time, and the hydraulic pressure is initially raised above the communication threshold but below the power threshold. Within this pressure range, communication signals and controls can be performed through the hydraulic line. The line pressure is raised to a selected level so that subsequent powering up of the hydraulic line pressure raises the line pressure to a certain level. Subsequent actuation of the well control devices, normally delayed as the pressure builds up within the long hydraulic tubing, occurs at a faster rate because the line is already pressurized to a certain level. The ready state pressure can be maintained slightly below the operation pressure so that a relatively small increase in fluid pressure activates the well tool.

The invention further permits the use of additional hydraulic lines and combinations of hydraulic lines and controllers to provide a hydraulically actuated well control and power system. One embodiment of the invention is based on the principle that a selected number of hydraulic control lines can be engaged with a tool and that control line combinations can be used for multiple purposes. For example, a three control line system could use a first line for hydraulic power such as moving a hydraulic cylinder, a second line to provide a return path for returning fluid to the initial location, and all three lines for providing digital-hydraulic code capabilities. Such code can be represented by the following Table:

| Hydraulic Lines | | | | |
|---|---|---|---|---|
| #1 | #2 | #3 | Digital Equation | Numeric Value Lines |
| 0 | 0 | 0 | $0 \times 2^2 + 0 \times 2^1 + 0 \times 2^0 =$ | 0 |
| 0 | 0 | 1 | $0 \times 2^2 + 0 \times 2^1 + 1 \times 2^0 =$ | 1 |
| 0 | 1 | 0 | $0 \times 2^2 + 1 \times 2^1 + 0 \times 2^0 =$ | 2 |
| 0 | 1 | 1 | $0 \times 2^2 + 1 \times 2^1 + 1 \times 2^0 =$ | 3 |
| 1 | 0 | 0 | $1 \times 2^2 + 0 \times 2^1 + 0 \times 2^0 =$ | 4 |
| 1 | 0 | 1 | $1 \times 2^2 + 0 \times 2^1 + 1 \times 2^0 =$ | 5 |
| 1 | 1 | 0 | $1 \times 2^2 + 1 \times 2^1 + 0 \times 2^0 =$ | 6 |
| 1 | 1 | 1 | $1 \times 2^2 + 1 \times 2^1 + 1 \times 2^0 =$ | 7 |

If "1" represents a pressurized line and if "0" represents an unpressurized line, then the combination of hydraulic lines provides the described code format for a binary communication code. Because the hydraulic line operation can use both a pressurized and an unpressurized line in a preferred embodiment of the invention, codes 000 and 111 would not be used in this embodiment. However, if one or more lines discharged fluid to the outside of the line to the tubing exterior, another tool, or other location, codes 000 and 111 would be useful for transmitting power or signals. If codes 000 and 111 are excluded from use in the inventive embodiment described, the following six codes are available for tool control:

| #1 | #2 | #3 | | |
|---|---|---|---|---|
| 0 | 0 | 1 | - | 1 |
| 0 | 1 | 0 | - | 2 |
| 0 | 1 | 1 | - | 3 |
| 1 | 0 | 0 | - | 4 |
| 1 | 0 | 1 | - | 5 |
| 1 | 1 | 0 | - | 6 |

Figure 3:
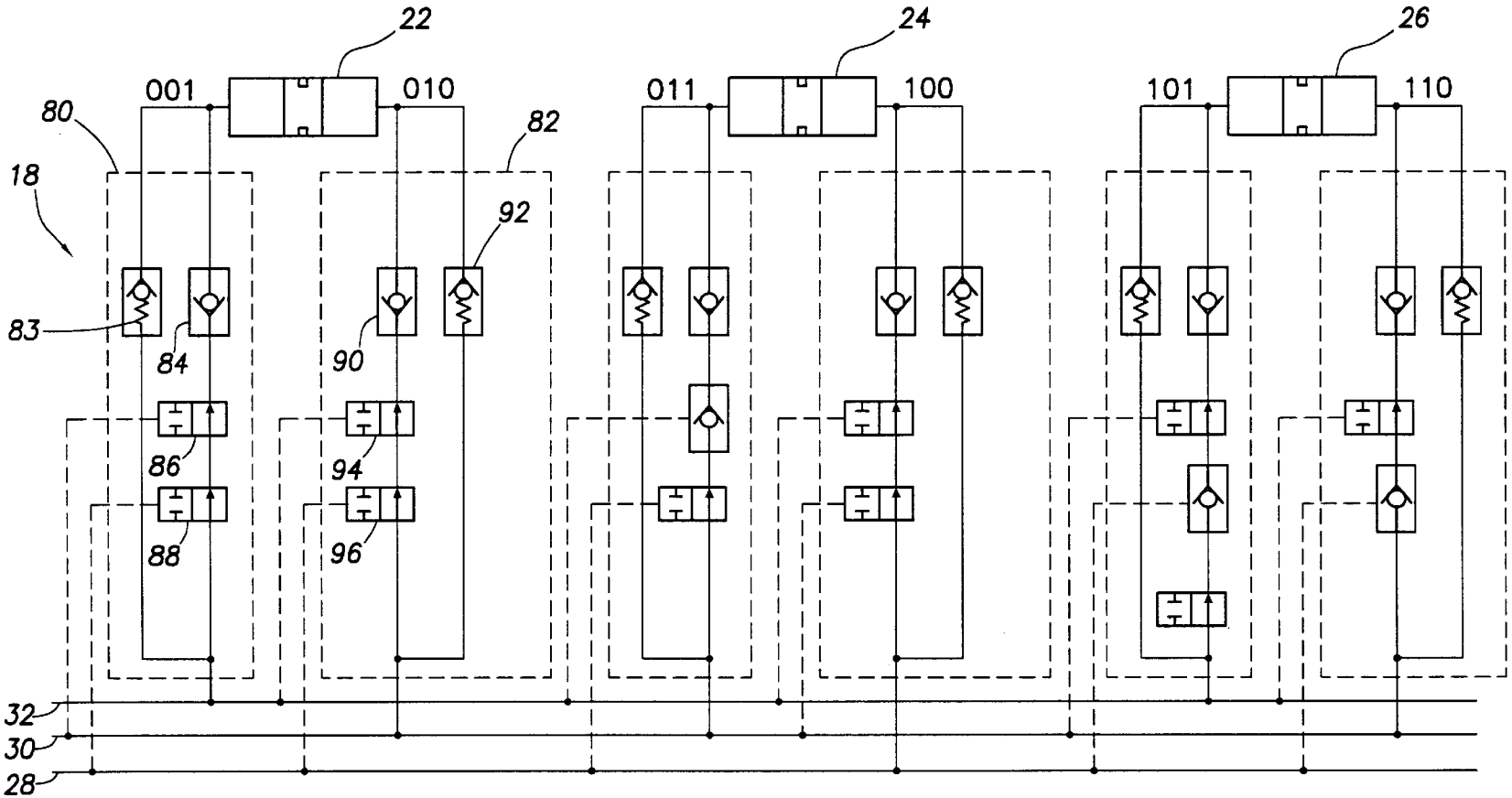
FIG. 3 illustrates a three well tool and three hydraulic line apparatus.

These codes are unique and can be grouped to provide six independent degrees of freedom to a hydraulic network. Different combinations are possible, and one combination permits the operation of three well tools such as ICVs 22, 24, and 26 having double actuated floating pistons as illustrated in FIG. 3. Lines 28, 30 and 32 are engaged between pump 14 and ICVs 22, 24, and 26. Lines 28, 30, and 32 could provide an opening code 001 for ICV 22. After a sufficient time lapse for all well tools such as the ICVs has occurred to detect and register the 001 code, the line pressure can be raised above the power threshold until a selected pressure level is achieved. The pressure can be held constant at such level, or varied to accomplish other functions. The selected well tool such as ICV 22 is actuated, and return fluid is directed back through one or more of the lines designated as a "0" , unpressurized line. Next, control line 32 is bled to zero and the entire system is at rest, leaving ICV 22 fully open until further operation. To open ICV 24, control lines 28, 30, and 32 can be coded and operated as illustrated. After sufficient time has passed, the system pressure can be increased to operate ICV 24. The degrees of control freedom and operating controls can be represented by the following instructions:

Hydraulic Line Number

| 28 | 30 | 32 | |
|---|---|---|---|
| 0 | 0 | 1 | Open ICV 22 |
| 0 | 1 | 0 | Close ICV 22 |
| 0 | 1 | 1 | Open ICV 24 |
| 1 | 0 | 0 | Close ICV 24 |
| 1 | 0 | 1 | Open ICV 26 |
| 1 | 1 | 0 | Close ICV 26 |

$$X = \frac{2^N - 2}{2}, \quad \text{and} \quad X = \frac{2^3 - 2}{2} = 3 \text{ control lines}$$

where

X equals the number of independently controlled ICVs, and N equals the number of control lines.

where

X equals the number of independently controlled ICVs, and

N equals the number of control lines.

The unique combination of valves and other components within each control module provides for unique, selected operating functions and characteristics. Operation of each line can be required in a particular sequence to match with the operability of a downhole tool. Depending on the proper sequence and configuration, pressurization of a hydraulic line can actuate one of the tools without actuating other tools in the system. Alternatively, various combinations of well tools could be actuated with the same hydraulic line if desired.

Another embodiment of the invention is described below, wherein the number of combinations per fixed number of hydraulic lines can be significantly increased by reordering the pressure sequence. "Sequence" as used herein relates to an order of succession or arrangement in a related or continuous series. For a two line system, line #1 can be pressurized first and line #2 can be pressurized second, or vice versa as illustrated below.

| Hydraulic Lines | | | |
|---|---|---|---|
| #1 | #2 | Digital Sequence | |
| 1 | 1 | 1(i) | 1(ii) |
| 1 | 1 | 1(ii) | 1(i) |

By sequentially reordering the distribution of pressure to hydraulic lines #1 and #2, a new variable of "relative order" permits additional pressure combinations to be incorporated into a well tool actuation system. Power can be added to the system from controller 20 to operate the selected well tool, and can be accomplished by providing additional hydraulic pressure to one or both hydraulic lines. A third "return line" can be added to convey hydraulic fluid to the well surface in a closed loop system, and the return line can be engaged with well tools operable by both the #1 and #2 control lines. Because both lines #1 and #2 end at the actuation pressure, the system is ultimately "blind" to the sequence order and can be reinitiated without depending upon prior sequences. This system is particularly useful for multiple hydraulic lines wherein the sequence combinations increase exponentially.

For three hydraulic lines:

| Hydraulic Lines | | | Digital Sequence | | |
|---|---|---|---|---|---|
| #1 | #2 | #3 | #1 | #2 | #3 |
| 1 | 0 | 0 | 1(i) | | |
| 0 | 1 | 0 | | 1(i) | |
| 0 | 0 | 1 | | | 1(i) |
| 1 | 1 | 0 | 1(i) | 1(ii) | |
| 1 | 1 | 0 | 1(ii) | 1(i) | |
| 1 | 0 | 1 | 1(i) | | 1(ii) |
| 1 | 0 | 1 | 1(ii) | | 1(i) |
| 0 | 1 | 1 | | 1(i) | 1(ii) |
| 0 | 1 | 1 | | 1(ii) | 1(i) |
| 1 | 1 | 1 | 1(i) | 1(ii) | 1(iii) |
| 1 | 1 | 1 | 1(i) | 1(iii) | 1(ii) |
| 1 | 1 | 1 | 1(ii) | 1(i) | 1(iii) |
| 1 | 1 | 1 | 1(ii) | 1(iii) | 1(i) |
| 1 | 1 | 1 | 1(iii) | 1(i) | 1(ii) |
| 1 | 1 | 1 | 1(iii) | 1(ii) | 1(i) |

From this example, multiple signal combinations can be created from a relatively small number of hydraulic lines. After the communication control signals have been transmitted by controller 14 through the hydraulic lines to actuate the selected well tools, power-up of the system can be accomplished by increasing the fluid pressure within selected hydraulic lines to operate the actuated well tool or tools. Following such event, continued system operation and additional sequences can be accomplished regardless of prior hydraulic line pressurization. This can be accomplished in different ways and occurs automatically for the last six sequences listed above because each of the three lines is ultimately pressurized. For the other sequences listed above, the well tools or actuators engaged with such well tools can be configured to reset to a particular state following completion of a time period or operation sequence.

In addition to alternatively to the sequential system described above, the invention permits the variable of selective power to increase the number of code sequence combinations available through a limited number of hydraulic lines. For a three line system having a return line the combination of sequential control would provide the following code combinations:

| Hydraulic Lines | | | Digital Sequence | | |
|---|---|---|---|---|---|
| #1 | #2 | #3 | #1 | #2 | #3 |
| 0 | 1 | 1 | 0 | 1(i) | 1(ii) |
| 0 | 1 | 1 | 0 | 1(ii) | 1(i) |

For a three line system wherein an increased actuation pressure is applied by controller 14 through selected hydraulic lines and one line is dedicated as a return line for closed loop operations, the number of code combinations can be increased as follows where "p" represents the selective application of pressure at a higher or lower activation pressure:

| Hydraulic Lines | | | Digital Sequence | | |
|---|---|---|---|---|---|
| #1 | #2 | #3 | #1 | #2 | #3 |
| 0 | 1 | 1 | 0 | 1(i)p | 1(ii) |
| 0 | 1 | 1 | 0 | 1(i) | 1(ii)p |
| 0 | 1 | 1 | 0 | 1(ii)p | 1(i) |
| 0 | 1 | 1 | 0 | 1(ii) | 1(i)p |

Figure 4:
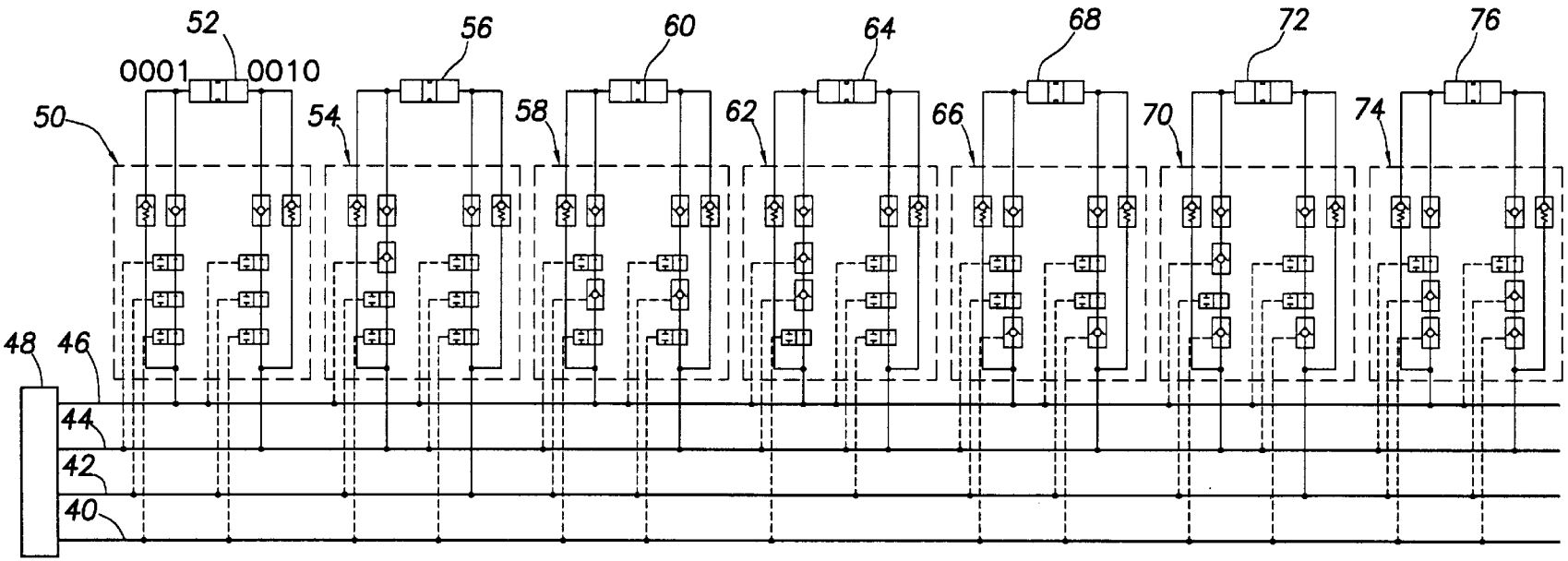
FIG. 4 illustrates a four line system.

The invention can be applied to a four line system as illustrated in FIG. 4, wherein control lines 40, 42, 44, and 46 are actuated or monitored by controller 48. Actuator 50 is engaged with tool 52, actuator 54 is engaged with tool 56, actuator 58 is engaged with tool 60, actuator 62 is engaged with tool 64, actuator 66 is engaged with tool 68, actuator 70 is engaged with tool 72, and actuator 74 is engaged with tool 76.

All four lines can be used to generate different system combinations similar to the three line system described above. For a four line system wherein one line is dedicated as a return line for closed loop operations, the number of code combinations can be illustrated as follows:

| Hydraulic Lines | | | | Digital Sequence | | | |
|---|---|---|---|---|---|---|---|
| #1 | #2 | #3 | #4 | #1 | #2 | #3 | #4 |
| 0 | 1 | 1 | 1 | 0 | 1(i) | 1(ii) | 1(iii)p |
| 0 | 1 | 1 | 1 | 0 | 1(i) | 1(ii)p | 1(iii) |
| 0 | 1 | 1 | 1 | 0 | 1(i)p | 1(ii) | 1(iii) |
| 0 | 1 | 1 | 1 | 0 | 1(i) | 1(iii) | 1(ii)p |
| 0 | 1 | 1 | 1 | 0 | 1(i) | 1(iii)p | 1(ii) |
| 0 | 1 | 1 | 1 | 0 | 1(i)p | 1(iii) | 1(ii) |
| 0 | 1 | 1 | 1 | 0 | 1(ii) | 1(i) | 1(iii)p |
| 0 | 1 | 1 | 1 | 0 | 1(ii) | 1(i)p | 1(iii) |
| 0 | 1 | 1 | 1 | 0 | 1(ii)p | 1(i) | 1(iii) |
| 0 | 1 | 1 | 1 | 0 | 1(ii) | 1(iii) | 1(i)p |
| 0 | 1 | 1 | 1 | 0 | 1(ii) | 1(iii)p | 1(i) |
| 0 | 1 | 1 | 1 | 0 | 1(ii)p | 1(iii) | 1(i) |
| 0 | 1 | 1 | 1 | 0 | 1(iii) | 1(i) | 1(ii)p |
| 0 | 1 | 1 | 1 | 0 | 1(iii) | 1(i)p | 1(ii) |
| 0 | 1 | 1 | 1 | 0 | 1(iii)p | 1(i) | 1(ii) |
| 0 | 1 | 1 | 1 | 0 | 1(iii) | 1(ii) | 1(i)p |
| 0 | 1 | 1 | 1 | 0 | 1(iii) | 1(ii)p | 1(i) |
| 0 | 1 | 1 | 1 | 0 | 1(iii)p | 1(ii) | 1(i) |

As illustrated by these examples of sequential application and selective power, significant code sequences can be transmitted through relatively few hydraulic lines. The invention can be extended into additional code combinations by overlaying sequential methods over the selective pressure techniques described herein. A four line system application could generate over 130 separate codes as controller 14 applies power to selected pressure lines. One such sequence of code combinations having hydraulic lines first actuated in the order (i), (ii), and (iii) is partially illustrated as follows:

| Digital Sequence | | | |
|---|---|---|---|
| #1 | #2 | #3 | #4 |
| 0 | 1(i) | 1(ii)p(i) | 1(iii)p(ii) |
| 0 | 1(i) | 1(ii)p(ii) | 1(iii)p(i) |
| 0 | 1(i)p(i) | 1(ii)p(ii) | 1(iii) |
| 0 | 1(i)p(ii) | 1(ii)p(i) | 1(iii) |

-continued

| Digital Sequence | | | |
|---|---|---|---|
| #1 | #2 | #3 | #4 |
| 0 | 1(i)p(i) | 1(ii) | 1(iii)p(ii) |
| 0 | 1(i)P(ii) | 1(ii) | 1(iii)p(i) |

In addition to the sequences described above, additional code sequences can be achieved if the relative pressure p is varied according to magnitude. Using this power level variable in combination with the selective power combinations or the sequential operation options described above, virtually unlimited code sequence combinations can be achieved. For example, pressure combinations can be accomplished at 2000 psi, 3000 psi, 3200 psi, or at other selected pressures. By adding the pressure variable to the other system variables identified above, multiple well combinations can be created with relatively few hydraulic lines.

In addition to the pressure magnitude variable described above, pressure distribution changes can be used to introduce another variable into the digital sequence. Pressure distribution changes can be formulated as a series of threshold levels, as a curve having discrete attributes or located within a selected time interval, or combination of these factors. The signal can be formed to efficiently correlate with the response of the hydraulic lines, actuator traits, and other factors.

As shown in FIG. 3, actuators 80 and 82 are engaged with tool 22. Actuator 80 includes spring loaded check 83, check valve 84, pilot operated valve 86, and pilot operated valve 88. Actuator 82 includes check 90, spring loaded check valve 92, pilot operated valve 94, and pilot operated valve 96. Other combinations of actuators can be substituted for the embodiment shown. For example, actuator 80 can be configured as a metering device which incrementally permits a limited movement following flow of a selected amount of fluid. Tool operation can be performed when a selected amount of fluid flow has been accomplished, thereby providing a reliable technique for avoiding premature or late operation of the selected tool. Such embodiment of the invention eliminates or substantially reduces the impact of constricted flow lines or debris or leaks which could cause premature or late operation of a pressure activated well tool.

By providing multiple combinations of communication and power capabilities through relatively few hydraulic lines, the invention significantly eliminates problems associated with limited available space and with pressure transients. In deep wellbores, the hydraulic lines are very long and slender, and this combination significantly limits the hydraulic line ability to quickly transmit pressure pulses or changes from the wellbore surface to a downhole tool location. In deep wellbores, five to ten minutes could be required before the hydraulic lines are accurately coded for the communication of sequenced controls. If some of the ICVs were located at relatively shallow depths in the wellbore, such ICVs would receive the code long before other ICVs located deep in the wellbore, thereby creating confusion on the digital-hydraulics control circuit.

This problem can be resolved by dedicating certain lines for communication signals and other lines for power. Communication signal lines could operate at relatively low pressures while the power lines could operate within higher pressure ranges. Alternatively, a preferred embodiment of the invention can utilize such time delay characteristics as a design variable by applying the communication coding early at relatively low pressures where the ICVs receive the codes but are not activated, and then increasing the pressure above a selected activation threshold to move the ICVs. This permits communication and power to be transmitted through the same hydraulic lines, and further uses the communication pressures to initially raise the line pressures to a selected level and thereby shorten the required power-up time.

The invention uniquely permits selective control of downhole tools while providing for recirculation of fluid within the hydraulic lines such as lines 10 and 12. Code combinations can be made so that fresh hydraulic fluid can be added to lines at the surface, and existing hydraulic fluid can be withdrawn from the system at the wellbore surface as the fresh hydraulic fluid is added. For example, a well tool such as an ICV can be pumped open with an open code "1010" (wherein the first and third lines are pressurized and the second and fourth lines are unpressurized) and pumped closed with a code "0110" (wherein the second and third codes are pressurized and the first and fourth codes are unpressurized). If fluid for an open tool condition was received from the first line and returned through the second line, then closing the tool would take fluid from the third line and return such fluid to the wellbore surface through the fourth line. Under such configuration, the fluid in each line would always travel in the same direction and could be circulated throughout the entire system without being reciprocated within the same line. This feature of the invention permits replacement of all hydraulic fluid during routine maintenance operations without withdrawing system components from the wellbore. This ability to change the hydraulic fluid from the wellbore surface significantly reduces lost production time and the resulting cost associated with such operations.

The ability to circulate fresh hydraulic fluid into the lines significantly prolongs the life of system components. Contaminant build-up and wear caused by fluid particles and seal debris is reduced, thereby prolonging the useful system life. In another embodiment of the invention, a fluid recirculation unit can be located downhole in the wellbore to permit hydraulic fluid to be recirculated and flushed within a downhole circulation loop. By eliminating the need to pump fresh fluid to each downhole tool through the line length positioned between the surface and the downhole tools, this feature of the invention would reduce the quantity of hydraulic fluid necessarily flushed through the system. In other embodiments of the invention, a selected line known to have heavy use could serve as the circulation line, thereby providing the convenient conduit for circulating fresh hydraulic fluid.

By controlling all hydraulic fluid flow from the wellbore surface, and by providing recirculation to the wellbore surface, unique monitoring capabilites are provided. The amount of fluid entering a line or leaving a return line can be monitored to determine and to verify the position and operation of downhole well tools. Similarly, the presence of fluid movement into a line without equal return fluid would provide information such as the presence of leaks within the system. In systems having four or more lines, test operation of the multiple lines could identify the leak source in the downhole tool or in the defective hydraulic line.

Real-time monitoring of the hydraulic fluid intake and outflow also provides a significant function in preventing over pressurization of a downhole tool such as a valve. By providing a closed volume and by monitoring the hydraulic fluid flow, overpressurization of the fluid intake line is prevented, thereby eliminating operator induced overpressurization and failure of the downhole tool. Flowmeters can operate by position sensing, by force deflection, or by other mechanisms.

The ability to control all hydraulic fluid movement from the wellbore surface also provides the unique function of reliable, infinitely variable control over downhole well tools. Downhole valves can be partially opened and closed to a selected degree, and such movement can be controlled partially and incrementally without requiring complete opening or closure of the tool during any given cycle. Infinitely variable tool control provides control not only over tool movement, displacement or position, but also over the power or force exerted by a downhole tool. Orifices can be selectively opened or closed, pistons can be moved in different directions, valves can be moved, the orientation of tool elements can be changed, perforating guns can be activated, and other mechanical operations can be accomplished downhole in the wellbore with minimal surface intervention. This capability provides significant design flexibility in the creation of downhole well tools and the functions performed by each tool.

The invention is applicable to many different tools including downhole devices having more than one operating mode or position from a single dedicated hydraulic line. Such tools include tubing mounted ball valves, sliding sleeves, lubricator valves, and other devices. The invention is particularly suitable for devices having a two-way piston, open/close actuator for providing force in either direction in response to differential pressure across the piston. For a three line system providing fifteen codes, various code combinations can be created for different systems. For example, the fifteen codes could handle fifteen single acting pistons such as packers and other devices. Up to seven double acting pistons such as ICV's, ball valves, and recirculation devices could be handled. Alternatively, different combinations of single and double devices could be handled, such as a combination of five double action and five single action devices. Alternatively, a single code could close all devices, with the remaining codes dedicated to the selective operation of different devices as previously described.

The variable of time can also be incorporated into the well control system. Activation time for a hydraulic line can be controlled through absolute time operation, by the duration of pulse operation, by a combination of different pulses sequenced by duration or time or relativity within a control order, or by other techniques.

Although the preferred embodiment of the invention permits hydraulic switching of the lines for operation of downhole well tools such as ICVs, switching functions could be performed with various switch techniques including electrical, electromechanical, acoustic, mechanical, and other forms of switches. The digital hydraulic logic described by the invention is applicable to different combinations of conventional and unconventional switches and tools and provides the benefit of significantly increasing system reliability and of permitting a reduction in the number of hydraulic lines run downhole in the wellbore. As used herein, the term "downhole" refers not only to vertical, slanted and horizontal wellbores but also refers to other remote control applications requiring tool actuator control. For example, the invention is applicable to subsea control applications in shallow or deep water, and to the conversion of geothermal energy into usable power.

The invention permits operating forces in the range above ten thousand pounds force and is capable of driving devices in different directions. Such high driving forces provide for reliable operation where environmental conditions causing scale and corrosion increase frictional forces over time. Such high driving forces also provide for lower pressure communication ranges suitable for providing various control operations and sequences.

The invention controls multiple downhole well tools while minimizing the number of control lines extending between the tools and the wellbore surface. A subsurface safety barrier is provided to reduce the number of undesirable returns through the hydraulic lines, and high activation forces are provided in dual directions. The system is expandable to support additional high resolution devices, can support fail-safe equipment, and can provide single command control or multiple control commands. The invention is operable with pressure or no pressure conditions, can operate as a closed loop or open loop system, and is adaptable to conventional control panel operations. As an open loop system, hydraulic fluid can be exhausted from one or more lines or well tools if return of the hydraulic fluid is not necessary to the wellbore application. The invention can further be run in parallel with other downhole wellbore power and control systems. Accordingly, the invention is particularly useful in wellbores having multiple zones or connected branch wellbores such as in multilateral wellbores.

Each downhole well tool is assigned a discrete identification address and reacts only to the assigned address code distributed through the hydraulic lines. Other address codes not correlating with the assigned code are ignored by the downhole tool. Actuators can be positioned downhole to identify the assigned code and for actuating operation of an engaged well tool or combination of tools. In this manner, selected well tools can be operated with full hydraulic power without actuating other well tools, and the efficiency of each individual hydraulic line is increased by the combination of multiple lines in the manner indicated.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for transmitting pressurized fluid between a wellbore surface and a well tool located downhole in the wellbore, comprising:

at least two hydraulic lines engaged with the well tool for conveying the fluid to the well tool, each hydraulic line providing communication control signals to actuate the well tool and providing fluid pressure to operate the well tool;

an actuator engaged with each hydraulic line and with the well tool for selectively operating the well tool; and a controller selectively pressurizing the fluid within each hydraulic line in a predetermined fluid pressure sequence to select the well tool for actuation and thereby initiate operation of the actuator, and the controller further increasing the pressure within a selected at least one of the hydraulic lines, thereby causing the actuator to operate the well tool.

2. An apparatus as recited in claim 1, wherein said actuator is capable of identifying a selected fluid pressure sequence and for actuating the well tool in response to said fluid pressure sequence.

3. An apparatus as recited in claim 1, wherein said controller includes a clock for selectively pressurizing the fluid at selected time intervals.

4. An apparatus as recited in claim 1, wherein said controller is capable of selectively pressurizing fluid in each hydraulic line in a selected sequence.

5. An apparatus as recited in claim 1, wherein said controller is capable of selectively pressurizing fluid in each hydraulic line for a selected time period.

6. An apparatus as recited in claim 1, further comprising a third hydraulic line engaged with the well tool for returning the fluid to the wellbore surface.

7. An apparatus as recited in claim 6, wherein said controller includes a fluid sensor for detecting the return of fluid through said third hydraulic line when another hydraulic line is pressurized.

8. An apparatus as recited in claim 1, wherein at least three hydraulic lines form a closed loop for circulating fluid downhole and for returning the fluid to the wellbore surface through at least one of said three hydraulic lines, further comprising means for detecting the return of fluid through a hydraulic line to the wellbore surface when another hydraulic line is pressurized.

9. An apparatus as recited in claim 1, wherein at least three well tools are each engaged with two or more hydraulic lines, further comprising a separate actuator engaged with each of said hydraulic lines and said well tools for actuating one of the well tools by the selective pressurization of one hydraulic line.

10. An apparatus as recited in claim 1, wherein at least three well tools are each engaged with two or more hydraulic lines, further comprising an actuator engaged with said hydraulic lines and said well tools for actuating one of the well tools by the selective pressurization of two hydraulic lines.

11. An apparatus as recited in claim 1, wherein said actuator is capable of incrementally operating in response to a selected quantity of fluid.

12. An apparatus as recited in claim 1, wherein said actuator is capable of operating following a selected time interval.

13. An apparatus as recited in claim 1, wherein said actuator is capable of operating in response to a selected fluid pressure sequence.

14. An apparatus for transmitting pressurized fluid between a wellbore surface and a well tool located downhole in the wellbore, comprising:

at least two hydraulic lines engaged with the well tool for conveying the fluid to the well tool, each hydraulic line providing communication control signals to actuate the well tool and providing fluid pressure to operate the well tool; and a controller selectively pressurizing the fluid within each hydraulic line and thereby providing the communication control signals in a predetermined fluid pressure sequence to select the well tool for actuation, and the controller applying a predetermined pressure to actuate the well tool.

15. An apparatus as recited in claim 14, further comprising an actuator engaged with said hydraulic lines and with the well tool for identifying a selected fluid pressure sequence, for identifying said selected fluid pressure, and for actuating the well tool in response to said fluid pressure sequence and selected fluid pressure.

16. An apparatus as recited in claim 14, wherein said controller selectively pressurizes fluid within a selected hydraulic line at a selected magnitude in combination with a selected fluid pressure sequence to actuate a selected well tool.

17. An apparatus as recited in claim 14, wherein said controller selectively pressurizes fluid within a selected hydraulic line at a selected pressure distribution, in combination with a selected fluid pressure sequence, to actuate a selected well tool.

18. An apparatus as recited in claim 14, wherein said controller selectively pressurizes fluid within a selected hydraulic line at a selected time interval, in combination with a selected fluid pressure sequence, to actuate a selected well tool.

19. An apparatus as recited in claim 18, wherein said controller selectively pressurizes fluid within a selected hydraulic line at a selected distribution within said selected time interval.

20. An apparatus as recited in claim 14, wherein said controller includes a fluid sensor for detecting the return of fluid through said third hydraulic line when another hydraulic line is pressurized.

21. A method of hydraulically controlling multiple well tools in a well, the method comprising the steps of:

interconnecting a plurality of hydraulic lines to each of the tools; and selecting a first one of the tools for actuation thereof by generating a first predetermined pressure on a first combination of the hydraulic lines, the first pressure being generated on the first combination of the hydraulic lines in a first predetermined sequence in which the first pressure is applied successively to selected ones of the first combination of the hydraulic lines.

22. The method according to claim 21, further comprising the step of selecting a second one of the tools for actuation thereof by generating the first predetermined pressure on the first combination of the hydraulic lines, the first pressure being generated on the first combination of the hydraulic lines in a second predetermined sequence.

23. The method according to claim 21, further comprising the step of selecting a second one of the tools for actuation thereof by generating the first predetermined pressure on a second combination of the hydraulic lines, the first pressure being generated on the second combination of the hydraulic lines in a second predetermined sequence.

24. The method according to claim 21, further comprising the step of permitting fluid communication between at least one of the first combination of the hydraulic lines and an actuator of the first well tool in response to the selecting step.

25. The method according to claim 24, wherein the actuator is pressure balanced prior to the selecting step.

26. The method according to claim 24, wherein the actuator is operative in response to pressure applied to first and second ports thereof, wherein the first and second ports are in fluid communication with each other prior to the selecting step, and wherein the selecting step further comprises preventing fluid communication between the first and second ports.

27. The method according to claim 26, wherein the selecting step further comprises permitting fluid communication between a first hydraulic line of the first combination of hydraulic lines and the first port, and permitting fluid communication between a second hydraulic line of the first combination of hydraulic lines and the second port.

28. The method according to claim 24, wherein the fluid communication permitting step further comprises permitting fluid communication between the actuator and each of first and second hydraulic lines of the first combination of the hydraulic lines, and wherein the method further comprises the step of generating a second pressure on the first hydraulic line after the fluid communication permitting step, thereby transmitting fluid from the first hydraulic line to the actuator.

29. The method according to claim 28, wherein the second pressure generating step further comprises receiving fluid from the actuator into the second hydraulic line in response to transmitting fluid from the first hydraulic line to the actuator.

30. The method according to claim 28, wherein in the second pressure generating step, the second pressure is greater than the first predetermined pressure.

31. The method according to claim 21, further comprising the step of preventing selection of the first tool for actuation thereof by generating the first pressure on a first hydraulic line of the first combination of the hydraulic lines, the first hydraulic line not being included in the selected ones of the first combination of the hydraulic lines.

32. The method according to claim 21, further comprising the step of preventing selection of the first tool for actuation thereof by generating fluid pressure on the first combination of the hydraulic lines in a second sequence.

33. A well control system, comprising:

a first valve assembly including a first actuation control device, a first actuator and a first valve; and first and second hydraulic lines interconnected to the first actuation control device, the first actuation control device responding to a first sequence of a first predetermined fluid pressure generated on the first hydraulic line and then a second predetermined fluid pressure generated on the second hydraulic line to permit fluid communication between the first actuator and at least one of the first and second hydraulic lines for operation of the first valve.

34. The well control system according to claim 33, wherein the first predetermined fluid pressure is substantially equal to the second predetermined fluid pressure.

35. The well control system according to claim 33, wherein the first actuator is pressure balanced by the first actuation control device while the first actuation control device prevents fluid communication between the first actuator and at least one of the first and second hydraulic lines.

36. The well control system according to claim 33, further comprising a second valve assembly including a second actuation control device, a second actuator and a second valve, the first and second hydraulic lines being interconnected to the second actuation control device, and the second actuation control device responding to a second sequence of the first predetermined fluid pressure generated on the second hydraulic line and then the second predetermined fluid pressure generated on the first hydraulic line to permit fluid communication between the second actuator and at least one of the first and second hydraulic lines for operation of the second valve.

37. The well control system according to claim 33, further comprising a third hydraulic line interconnected to the first actuation control device, the first actuation control device preventing fluid communication between the first actuator and at least one of the first and second hydraulic lines when fluid pressure is generated on the third hydraulic line.

* * * * *